US005184992A

United States Patent [19]

Banks

[11] Patent Number: 5,184,992

[45] Date of Patent: Feb. 9, 1993

[54] MULTI-STATION PHYSICAL EXERCISE APPARATUS

[76] Inventor: Gary S. Banks, 529 Bonita Ct., Vallejo, Calif. 94591

[21] Appl. No.: 892,682

[22] Filed: May 27, 1992

Related U.S. Application Data

[63] Continuation of Ser. No. 667,595, Mar. 5, 1991, abandoned.

[51] Int. Cl.[5] ..... A63B 21/06

[52] U.S. Cl. ..... 482/104; 482/98

[58] Field of Search ..... 482/93, 94, 97, 98, 482/99, 100, 101, 102, 103, 104, 106, 133, 135, 138

[56] References Cited

U.S. PATENT DOCUMENTS

| | | | |
|---|---|---|---|
| 2,470,081 | 5/1949 | Harvey . | |
| 3,190,648 | 6/1965 | Kallenbach . | |
| 3,235,255 | 2/1966 | Leflar . | |
| 3,257,111 | 6/1966 | Martin | 272/118 |
| 3,346,256 | 10/1967 | White | 272/123 X |
| 3,524,644 | 8/1970 | Kane . | |
| 3,612,523 | 10/1971 | Glynn | 272/118 |
| 3,902,717 | 9/1975 | Kulkens . | |
| 4,093,214 | 6/1978 | Coker et al. | 272/118 |
| 4,252,314 | 2/1981 | Ceppo . | |
| 4,358,107 | 11/1982 | Nissen . | |
| 4,358,108 | 11/1982 | Voris . | |
| 4,390,179 | 6/1983 | Szkalak . | |
| 4,470,596 | 9/1984 | Desiderio | 272/118 |
| 4,527,797 | 7/1985 | Slade, Jr. et al. | 272/123 |
| 4,564,194 | 1/1986 | Dawson . | |
| 4,744,560 | 5/1988 | Azari . | |
| 4,750,239 | 6/1988 | Ladge | 272/123 X |
| 4,934,693 | 6/1990 | Santoro | 272/123 |
| 4,998,723 | 3/1991 | Santoro | 272/123 X |
| 5,050,868 | 9/1991 | Pearson | 482/104 X |

FOREIGN PATENT DOCUMENTS

| | | | |
|---|---|---|---|
| 456790 | 3/1928 | Fed. Rep. of Germany | 482/104 |
| 2328486 | 5/1977 | France | 482/104 |

*Primary Examiner*—Robert Bahr
*Attorney, Agent, or Firm*—Schapp & Hatch

[57] ABSTRACT

What is disclosed is a physical exercise apparatus including two barbell disc carrying carriages each of which is independently, freely moveable along a pair of vertical rails upon each of which it is mounted by a pair of widely spaced outboard bearings. Each carriage is provided with an inwardly projecting stub shaft to which one end of a lift bar may be affixed by means of a sliding collar, thereby adapting the apparatus for barbell exercises. A plurality of captive cables is provided whereby the respective carriages and their associated barbell disc weights may be used to provide the resistance for different physical exercises executed simultaneously by different persons employing the same apparatus.

9 Claims, 5 Drawing Sheets

MULTI-STATION PHYSICAL EXERCISE APPARATUS

This is a continuation of application Ser. No. 667,595, filed on Mar. 5, 1991, now abandoned.

BACKGROUND OF THE INVENTION

1. Field of the Invention

My invention relates to exercise apparatus, and more particularly to free-standing, multi-station weight lifting apparatus.

2. Description of the Prior Art

The term "prior art" as used herein or in any statement made by or on behalf of applicant means only that any document or thing referred to as prior art bears, directly or inferentially, a date which is earlier than the effective filing date hereof.

Physical exercise apparatus incorporating captive or guided barbells is well known in the prior art.

Apparatus incorporating captive or guided barbells is shown and described in U.S. Pat. No. 4,252,314, issued to Louis Ceppo on Feb. 24, 1981; U.S. Pat. No. 4,564,194, issued to Fred Dawson on Jan. 14, 1986; and U.S. Pat. No. 4,744,560, issued to John Azari on May 17, 1988.

In the devices of the Dawson and Ceppo patents a lift bar is slidably attached to a pair of vertical guide posts located at the opposite sides of the exercise station, the lift bar projecting beyond the vertical guide posts so that weights can be mounted thereupon in the conventional manner. Further, the devices of both of these patents are single-station machines, in that the attaching cable for auxilliary devices, such as a lat bar, is in both devices trained over a pair of pulleys located in a plane of symmetry equidistant from both guide posts, and thus the devices of these patents can be used to provide physical exercise to only one person at a time.

Further, in the devices of both of these patents the cable is hooked to the center of the lift bar, and thus even a slight lack of balance of the weight carrying assembly, i.e., the bar, guide sleeves, etc., or a slight dissymmetry in the placement of the weights on the outwardly projecting stubs of the lift bar, results in binding between the guide sleeves and the guide posts which critically detracts from the effectiveness of these devices and their enjoyment by their users.

Yet further, in the devices of these patents, the lift bars are affixed to the outer faces of the guide sleeves, i.e., the axes of the lift bars do not intersect the axes of the guide posts, and thus a cocking tendency is produced which can lead to noticeable binding between the guide sleeves and the guide posts, especially when the application of heavy weights to the outwardly projecting ends of the lift bar causes the lift bar to flex.

While the devices of these patents eliminate the use of weight stacks or "plates", they fall far short of providing the user with smooth, unhindered movement of weight, i.e., smooth, unhindered resistance, during exercise.

The device of the Azari patent is also a guided or captive lift bar machine. However, the device of the Azari patent does not utilize the disc weights mounted on the lift bar to provide alternative modes of exercise, e.g., the use of a lat bar, but rather incorporates auxilliary stacks of horizontally disposed weights, sometimes called "plates", to provide these alternative forms of physical exercise.

While Azari teaches that his device is characterized by "a substantially compact frame wherein the overall structure is of a relatively reduced size so as to be operatively positioned within a reduced area" it appears clear that the device of the Azari patent would have to be at least eleven to twelve feet long, five feet deep, and seven feet high.

Further, even though the axis of the lift bar of the device of the Azari patent intersects the axes of the vertical guide posts, the fact that the weights are carried by stubs directly connected to the guide sleeves, and the close fit between the guide sleeves and the guide posts, results in the danger of binding when heavy weights are carried by the stubs and consequently the lift bar flexes.

It is believed that the documents listed immediately below contain information which is or might be considered to be material to the examination of this patent application.

| Patent No. | Inventor |
|---|---|
| 2,470,815 | R. Harvey |
| 3,190,648 | T. Kallenbach |
| 3,235,255 | L. LeFlar |
| 3,524,644 | J. Kane |
| 3,902,717 | F. Kulkens |
| 4,358,107 | G. Nissen |
| 4,358,108 | H. Voris |
| 4,390,179 | K. Szkalak |
| 4,564,193 | |

No representation or admission is made that any of the above-listed patents is part of the prior art, or that a search has been made, or that no more pertinent information exists.

A copy of each of the above-listed patents is being supplied to the Patent and Trademark Office herewith.

SUMMARY OF THE INVENTION

Accordingly, it is an object of my present invention to provide multi-station physical exercise apparatus of the captive lift bar type which is characterized by substantially total freedom from sticking and binding of the lift bar, however heavily weighted.

Another object of my present invention is to provide multi-function physical exercise apparatus of the captive lift bar type which is a multi-station machine, i.e., is capable of simultaneously providing physical exercise for two or more persons.

Yet another object of my present invention is to provide multi-station physical exercise apparatus of the captive lift bar type which is capable of simultaneously providing physical exercise for two or more persons, and which at the same time is far more compact that the multi-station, captive lift bar physical exercise apparatus of the prior art.

A yet further object of my present invention is to provide multi-station physical exercise apparatus of the captive lift bar type wherein the same weights which are sometimes attached to the opposite ends of the lift bar can at other times be employed independently, without dismounting from their respectively associated guide rails, to provide the resistance needed for auxilliary exercise devices, such as lat bars, pull-down bars or butterfly apparatus.

An additional object of my present invention is to provide an exercise bench adapted to be interengaged with my abovedescribed captive lift bar physical exercise apparatus, which bench is equipped with multi-arm leg exercise apparatus the resistance for which is derived by cable from the set of weights associated with one end only of the lift bar, which set of weights is then coupled to its associated vertical guide posts, but is not attached to the lift bar.

A yet further object of my present invention is to provide captive lift bar physical exercise apparatus in which the lift bar can be locked at any selected one of a plurality of heights by a simple twisting of the lift bar, and in which the height selecting means are very easily and rapidly moved from one selected height to another.

Other objects of my present invention will in part be obvious and will in part appear hereinafter.

My present invention, accordingly, comprises the apparatus embodying features of construction, combinations of elements, and arrangements of parts all as exemplified in the following disclosure, and the scope of my present invention will be indicated in the claims appended hereto.

In accordance with a principal feature of my present invention captive lift bar physical exercise apparatus is provided wherein each end of the lift bar is engaged with a carriage, and each carriage is adapted to slidably engage a pair of upright guide rods.

In accordance with another principal feature of my present invention there is journaled in each such carriage a stub shaft the axis of which is perpendicular to the plane containing the axes of the two associated guide rods.

In accordance with yet another principal feature of my present invention said stub shaft projects outwardly from both faces of said carriage, and the diameter of said stub shaft is equal to the diameter of a standard lift bar, such that standard barbell discs can be affixed in the well known manner to both ends of said stub shaft, adjacent both major faces of said carriage.

In accordance with a further principal feature of my present invention said lift bar is provided at both ends with slidable collars adapted to slidably engage both of said stub shafts, such that when the lift bar is interposed between the adjacent ends of the stub shafts and each sliding collar is engaged with and affixed to both the lift bar and one of the stub shafts, a unitary assembly is provided which includes the lift bar, both stub shafts, both carriages, and any disc weights which have been passed over and secured to the stub shafts.

In accordance with an additional principal feature of my present invention each of said carriages is provided with securing means for securing a cable thereto, by means of which cable the carriage may be attached to an auxilliary exercise device, such as a lat bar or a "butterfly".

In accordance with yet another principal feature of my present invention each such carriage is provided with a pair of vertically disposed, elongated, rigid tubes having sleeve bearings affixed in at least the outer ends thereof, each of which sleeve bearings close-fittingly and slidably embraces one of the associated vertical guide rods.

In accordance with yet another principal feature of my present invention an elongated hook member is affixed to the end of each stub shaft nearest the other carriage, and projects perpendicularly thereto.

In accordance with a further principal feature of my present invention each pair of said guide rods is maintained upright and in parallelism by an end frame including two vertical frame members, and opposing ones of said frame members are provided with spaced openings adapted to receive a projecting member, which projecting member is aligned with and adapted to engage with the corresponding one of said hooks, in whatever opening it is engaged.

In accordance with a yet further principal feature of my present invention said end frames are interconnected by a plurality of rigid, horizontal transverse structural members, whereby said end frames are maintained in upright, parallel, mutually confronting relation.

In accordance with an additional principal feature of my present invention said transverse structural members are rigidly maintained perpendicular to said end frames, whereby the planes containing the axes of the guide rods of each pair are maintained in rigid parallelism, and any line perpendicular to the axis of one guide rod and perpendicular to one of said planes intersects the axis of an opposing guide rod.

In accordance with another principal feature of my present invention the upper member of each of said end frames is provided with a plurality of pulleys over which is trained at least one captive cable, the inner end of each captive cable being provided with snap fastener means adapted to engage the cable securing means which is a part of the associated carriage.

In accordance with an additional principal feature of my present invention the outer end of each such captive cable is attached to an auxilliary exercise device, such as a hand stirrup, a lat bar, or a "butterfly" device, either directly or by means of suitable snap fastening means.

In accordance with a principal feature of a second embodiment of my present invention a continuous, rigid rod is substituted for said stub shafts and lift bar.

For a fuller understanding of the nature and objects of my present invention, reference should be had to the following detailed description, taken in connection with the accompanying drawings.

BRIEF DESCRIPTION OF THE DRAWINGS

FIG. 1A is a partial perspective view from beneath of one of the upper end frame members of the physical exercise apparatus of FIG. 1;

DESCRIPTION OF THE PREFERRED EMBODIMENTS

Figure 1:
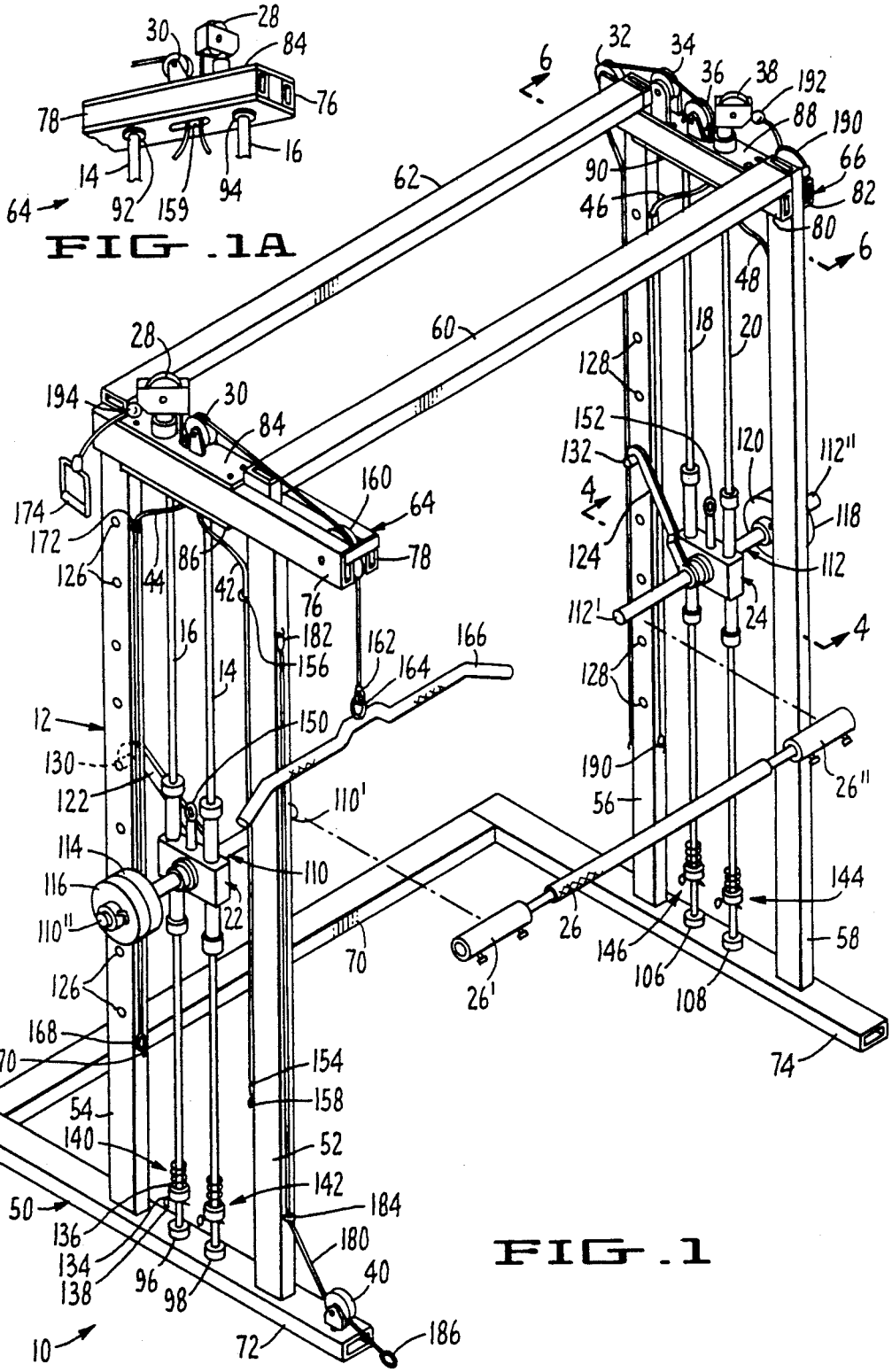
FIG. 1 is a perspective view of a multi-station captive lift bar physical exercise apparatus constructed in accordance with my invention.

Referring now to FIG. 1, there is shown a free-standing, multi-station physical exercise device 10 constructed in accordance with the first preferred embodiment of my invention.

As seen in FIG. 1, exercise device 10 is principally comprised of a frame 12, a plurality of rigid rails 14, 16, 18, 20 affixed to frame 12, a pair of carriages 22, 24 slidably mounted on rails 14, 16 and 18, 20, respectively, a lift bar 26, a plurality of pulleys 28, 30, 32, 34, 36, 38, 40 mounted on frame 12, and a plurality of captive cables 42, 44, 46, 48, trained over said pulleys.

As further seen in FIG. 1, frame 12 is comprised of a base 50, a plurality of posts 52, 54, 56, 58, a pair of longitudinal beams 60, 62, and two transverse beams 64, 66.

Referring again to FIG. 1, it will be seen that base 50 is comprised of a longitudinal, rectangular tubular member 70 and two transverse, rectangular tubular members 72, 74.

In the first preferred embodiment of my invention the several members 70, 72, 74 of base 50 are joined together by means of demountable joints for ease of shipping and storage. For example, transverse member 72, 74 may be provided with tongues which fit closely within the respective ends of longitudinal member 70, and suitable fastening means, such as nuts and bolts may be provided whereby to retain said tongues in the ends of longitudinal member 70. It is to be understood that these demountable joints serve to maintain members 72 and 74 rigidly and precisely perpendicular to member 70.

Further, each of the posts 52, 54, 56, 58 is affixed to base 50, and maintained rigidly perpendicular thereto, by means of similar demountable joints.

Posts 52, 54, 56, 58, and longitudinal beams 60, 62, are all preferably fabricated from the same tubular stock material as are the three base members 70, 72, 74.

As further seen in FIG. 1, transverse beams 64, 66 are both compound beams, transverse beam 64 being comprised of a pair of tubular members 76, 78, and transverse beam 66 being comprised of a pair of tubular members 80, 82. Beam members 76, 78, 80, 82 are preferably fabricated from the same tubular material as posts 52, 54, etc., and base members 70, 72, 74.

Transverse beam members 76, 78 are rigidly affixed to the upper ends of posts 52, 54 by suitable demountable joining means, and transverse beam members 80, 82 are rigidly affixed to the upper ends of posts 56, 58 by suitable demountable joint means.

Further, longitudinal beams 60, 62 are rigidly affixed at their opposite ends to transverse beam members 78, 80 by suitable demountable joint means.

Transverse beam 64 is further comprised of upper and lower plates 84, 86, which are bolted, respectively, to the upper and lower faces of beam members 76, 78 in the manner indicated in FIG. 1.

Similarly, transverse beam 68 is further comprised of an upper plate 88 and a lower plate 90, which are bolted, respectively, to the upper and lower faces of beam members 80, 82.

Thus, it will be seen that frame 12 is a strong, rigid rectangular frame which can be easily erected on a suitable flat, horizontal surface of sufficient load-bearing strength, and will not be perceptibly distorted by the application to it of the forces produced by the weights borne thereby or the stresses produced by the manipulation of those weights, etc., in the carrying out of physical exercises.

Figure 6:
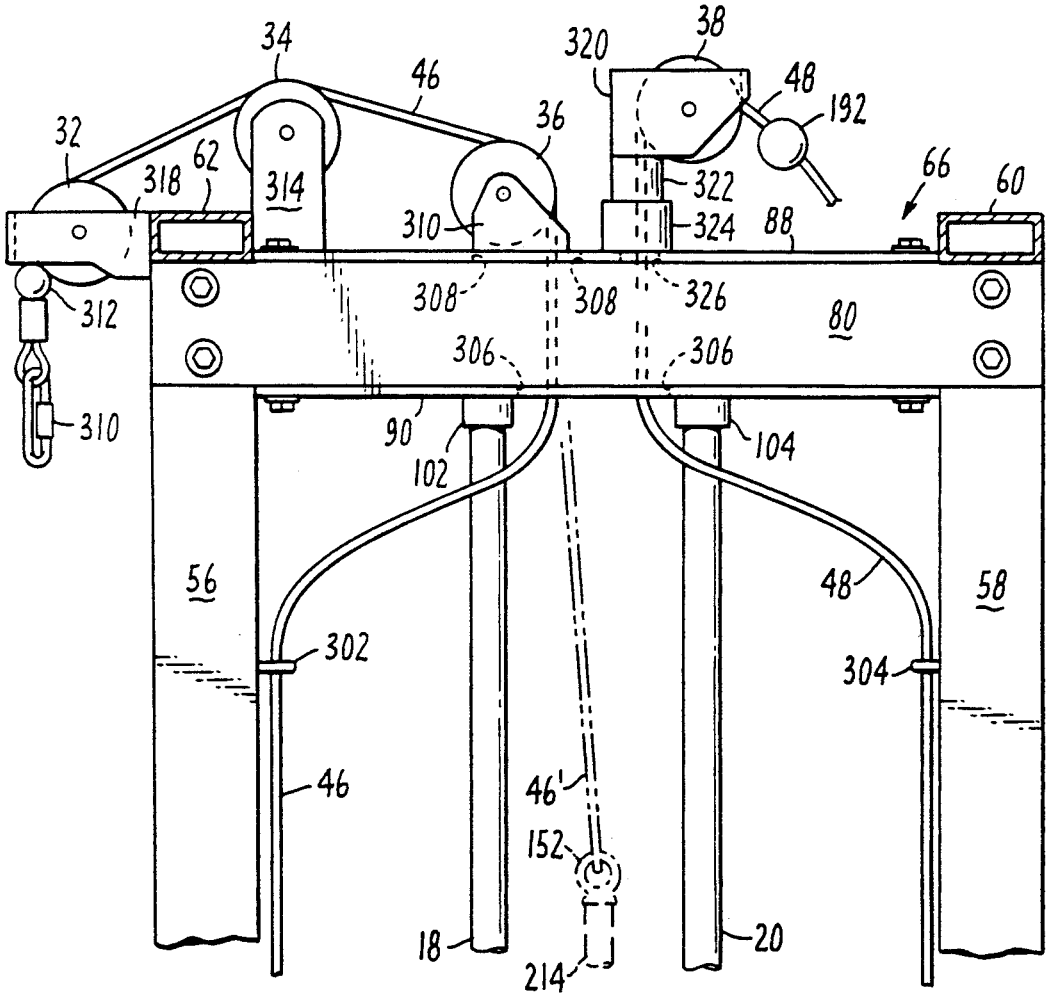
FIG. 6 is a partial elevational view of the physical exercise apparatus shown in FIG. 1, particularly illustrating the pulleys mounted on the upper horizontal member of the right-hand end frame as seen in FIG. 1, and the captive cables trained over those pulleys.

As further seen in FIG. 1, and in FIGS. 1A and 6, a plurality of bosses 92, 94, 96, 98, 102, 104, 106, 108 are provided on frame 12. As seen in FIG. 1A, for example, bosses 92, and 94 are provided on the lower surface of plate 86 of transverse beam 64. As seen in FIG. 1, bosses 96 and 98 are provided on the upper face of base member 72. As seen in FIG. 6, bosses 102 and 104 are provided on the lower face of plate 90. As also seen in FIG. 1, bosses 106 and 108 are provided on the upper face of base member 74.

Each of these bosses is provided with a central bore which close-fittingly receives the corresponding end of one of the rails 14, 16, 18, 20, as shown in FIG. 1.

Thus, it will be seen that frame 12 rigidly maintains rails 14, 16, 18, 20 in mutually parallel relationship, with a first plane containing the axes of rails 14 and 16 parallel to a second plane containing the axes of rails 18 and 20, a third plane containing the axes of rails 14 and 20 perpendicular to said first and second planes, and a fourth plane containing the axes of rails 16 and 18 also perpendicular to said first and second planes.

As further seen in FIG. 1, a carriage 22 is slidably mounted on rails 14 and 16, and a carriage 24 is slidably mounted on rails 18 and 20.

Figures 2, 2A, 3:
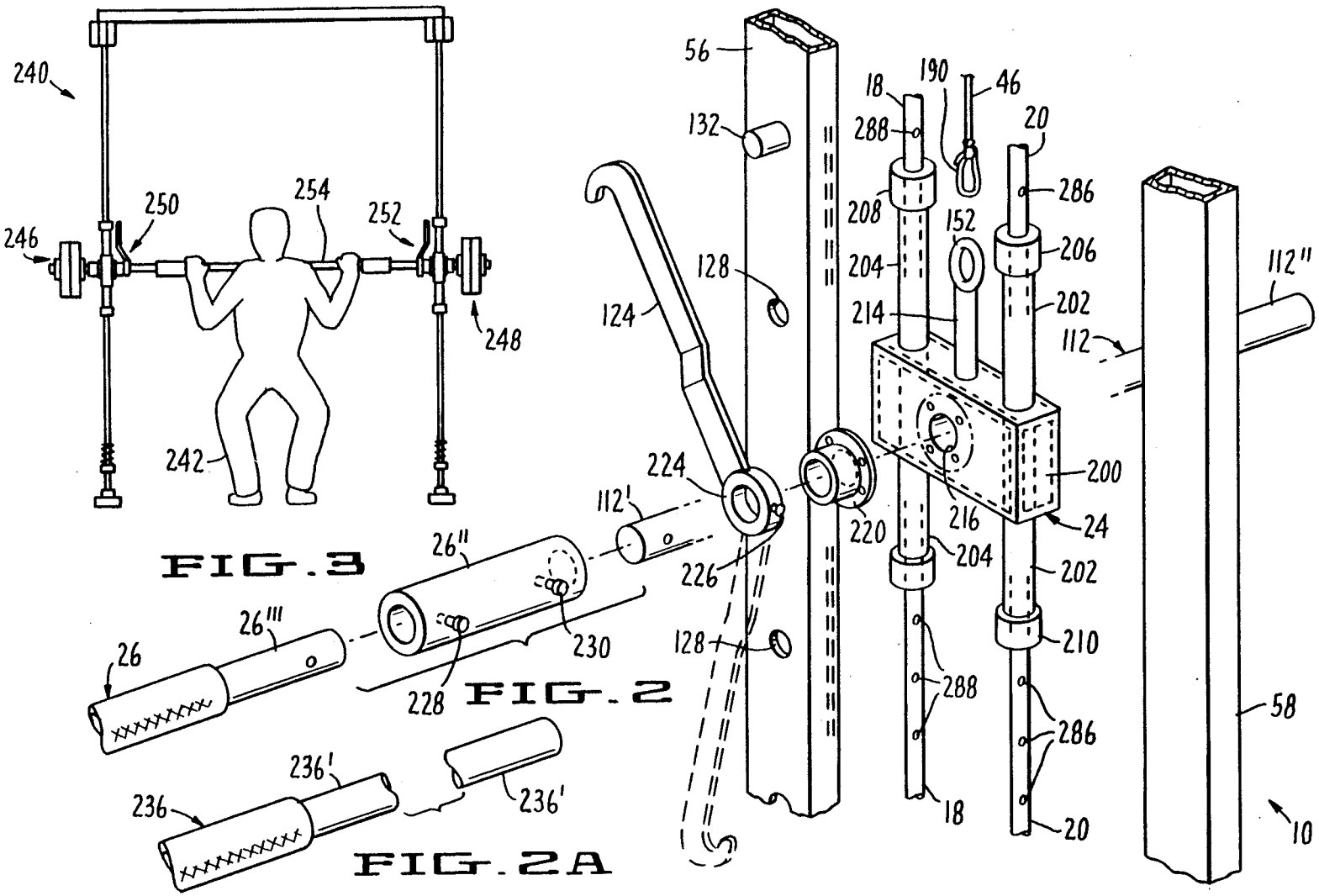
FIG. 2 is an exploded view in perspective of a part of the physical exercise apparatus of FIG. 1, particularly showing the bar-and-carriage assembly.
FIG. 2A is a partial perspective view of the lift bar of a second preferred embodiment of my invention.
FIG. 3 is a partial view in elevation of the physical exercise apparatus of FIG. 1, particularly illustrating its mode of use in executing those exercises normally performed with barbells.
Figure 5:
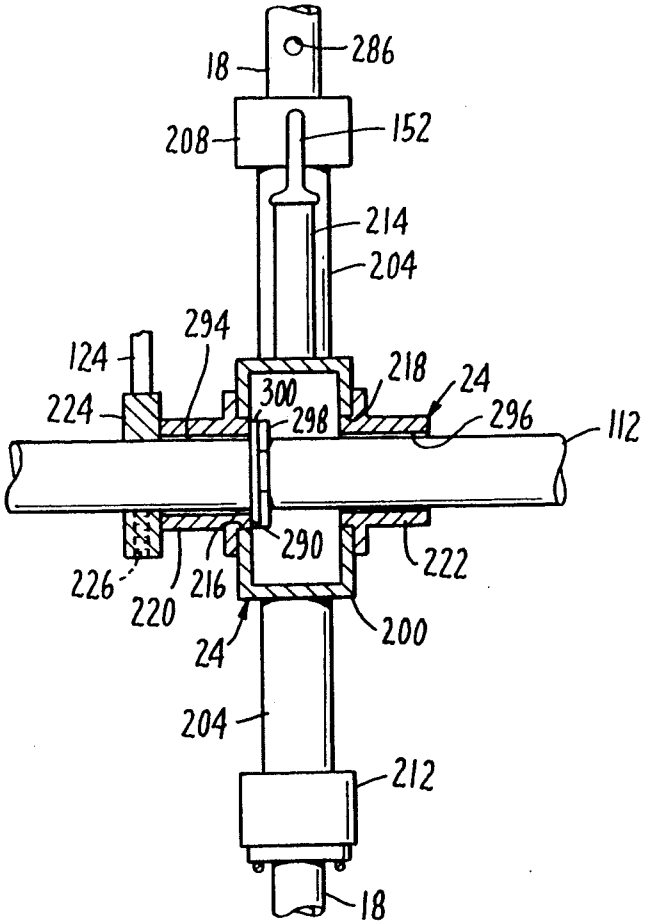
FIG. 5 is a transverse view, partly in section, of the part of my invention shown in FIG. 4, taken on plane 5—5 of FIG. 4.
Figure 4:
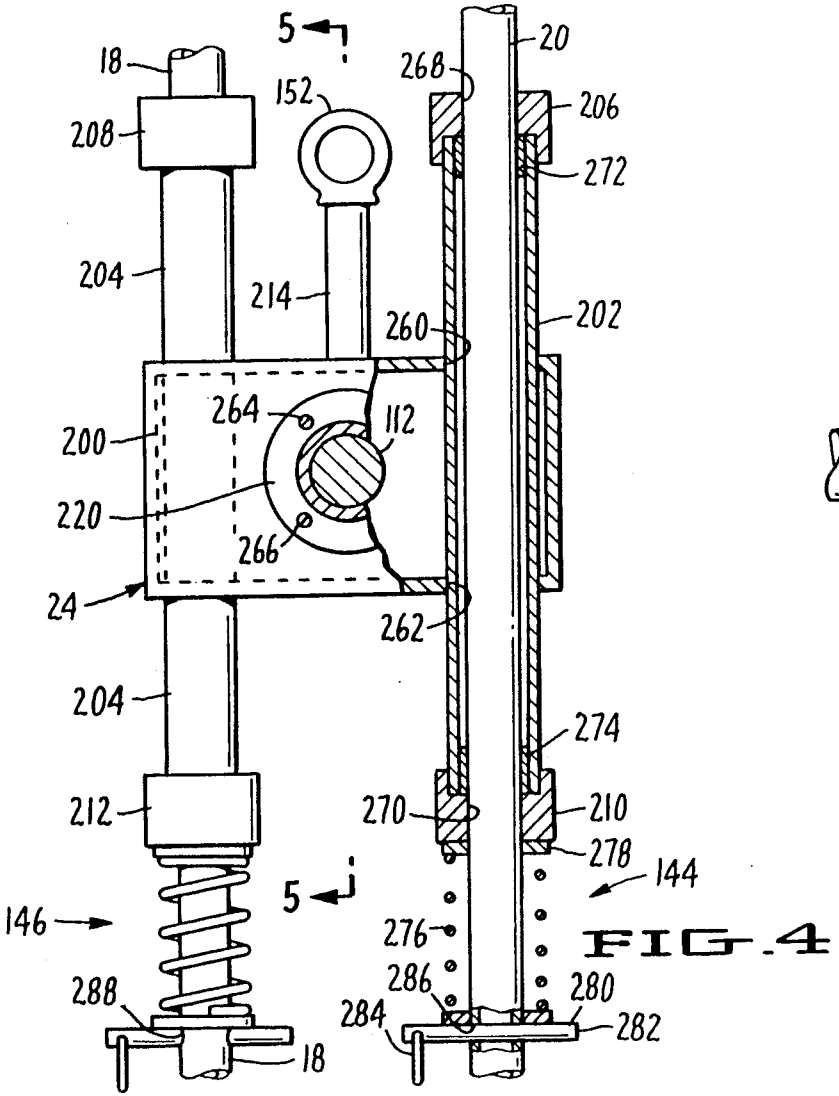
FIG. 4 is a partial view in elevation, partially in section, of the physical exercise apparatus of FIG. 1, particularly illustrating the carriage structure of the first preferred embodiment of my invention.

Carriages 22 and 24, which constitute a principal feature of my invention, are shown in FIGS. 2, 4, and 5, and are described in detail hereinbelow.

It is to be noted here, however, that a shaft 110 passes through and is journaled in carriage 22, thus providing an inwardly projecting stub shaft 110′ and an outwardly projecting stub shaft 110″.

Similarly, a shaft 112 passes through and is journaled in carriage 24, thus providing an inwardly projecting stub shaft 112′ and an outwardly projecting stub shaft 112″.

As also seen in FIG. 1, barbell weights, e.g., 114, 116, of well known type may be disposed upon outwardly projecting stub shaft 110″, and secured thereon by a collar of the well known type.

Similarly, barbell weights, e.g., 118, 120, may be disposed upon stub shaft 112″ and secured thereon by means of a collar of well known type.

The number and weight of barbell weights to be disposed upon stub shafts 110″, 112″ will be readily determined by the user of exercise device 10.

Similarly, in the certain uses of exercise device 10 additional barbell weights may also be disposed upon inwardly projecting stub shafts 110′, 112′ by the user or users of exercise device 10.

As further seen in FIG. 1, lift bar 26 is provided at its opposite ends with sliding sleeves 26′, 26″ which are adapted to close-fittingly embrace stub shafts 110′, 112′, respectively. Each sleeve 26′, 26″ is also provided with at least one set screw by means of which it can be secured to its corresponding stub shaft 110′, 112′, and to lift bar 26. My invention is not limited to the use of set screws in this connection.

As also shown in FIG. 1, the length of lift bar 26 is substantially equal to but slightly smaller than the distance between the adjacent ends of stub shafts 110', 112'.

Thus, stub shaft may be coaxially aligned with and affixed to stub shafts 110', 112', as shown in FIG. 3, whereby exercise device 10 may be used for the performance of well known barbell exercises.

As further seen in FIG. 1, stub shaft 110' is provided with a perpendicularly disposed hook 122, and stub shaft 112' is provided with a perpendicularly disposed hook 124.

Further, rear post 54 is provided with a plurality of pairs of aligned holes 126, the holes of each pair passing through the respective major faces of tubular member 54. Similarly, tubular rear post 56 is provided with a corresponding plurality of pairs of aligned holes 128, the axis of each pair of aligned holes 126 being coincident with the axis of the corresponding pair of aligned holes 128. Thus, for example, the uppermost pair 126 of holes in tubular post 54 is located at the same distance above base member 72 as the uppermost pair 128 of holes is located above base member 74. Put differently, each hole pair 126 is located at the same distance above base 50 as a corresponding hole pair 128.

As further seen in FIG. 1, a pair of pins 130, 132 is supplied, which pins are adapted to be close-fittingly received in selected ones of said hole pairs 126, 128. In the practice of my invention pins 130 and 132 are disposed in corresponding ones of said hole pairs, i.e., hole pairs which are located the same distance above base 50, and thus are adapted to coact with hooks 122, 124, as seen in FIG. 1, in order to maintain carriages 22, 24 at a selected, predetermined distance above base 50.

As explained hereinafter, hooks 22, 24 are both irrotatably affixed to corresponding stub shafts 110', 112', and thus, when lift bar 26 is attached to stub shafts 110', 112', hooks 22, 24 can be detached from pins 130, 132 by slightly raising lift bar 26 and rotating lift bar 26 about its axis.

As further seen in FIG. 1, a stop 134 is located near the bottom of rail 16, and is maintained at the height shown by means of a pin 138. A coil spring 136 is disposed upon stop 134. This entire assembly of stop 134, retaining pin 138, and spring 136 will sometimes be referred to hereinafter as carriage stop 140.

As best seen in FIG. 2, each rail 14, 16, 18, 20 is provided with a plurality of transverse holes for receiving a pin such as pin 138, whereby to position the associated carriage stop at any selected one of a predetermined plurality of heights above base 50.

As further seen in FIG. 1, a substantially identical carriage stop 142 is provided on rail 14, another substantially identical carriage stop 144 is provided on rail 20, and yet another substantially identical carriage stop 146 is provided on rail 18.

As also seen in FIG. 1, an eye 150 is affixed to the upper surface of carriage 22, and an eye 152 is affixed to the upper face of carriage 24.

As also seen in FIG. 1, captive cable 42, when unused, is retained in hooks 154, 156, which are affixed to the rear face of post 52. A snap hook 158 is affixed to the lower end of captive cable 42, and is adapted to be interengaged with eye 150 of carriage 22 when captive cable 42 is withdrawn from hooks 154, 156.

Captive cable 42 passes upward through an opening 159 in lower plate 86 (FIG. 1A), a corresponding opening in plate 84, is trained over pulley 30, over a pulley 160 mounted in the outer end of beam 64, and then passes downward and terminates in a snaphook 162 which is secured to an eye 164 affixed to a lat bar 166.

Thus, it will be seen that carriage 22, and the weights affixed to its stub shafts 110', 110'', may be independently used (in the absence of lift bar 26) to provide the resistance needed in connection with lat bar 166, by unshipping captive cable 42 from hooks 154, 156 and engaging snap hook 158 with eye 150 of carriage 22.

As will now be evident to those having ordinary skill in the art, informed by the present disclosure, captive cable 44 is provided at its lower end with a snaphook 168 which is engagable with eye 150 of carriage 22, and is normally maintained when not in use in a pair of hooks 170, 172 affixed to the forward face of post 54.

The upper end of captive cable 44 passes through opening 159, through said corresponding opening in plate 84, is trained over rotatable pulley 28, and terminates in a hand stirrup 174.

Thus, as will be evident to those having ordinary skill in the art, carriage 22 and its associated weights may be independently used to provide the desired resistance to the outward movement of hand stirrup 174 by disengaging captive cable 44 from its associated hooks 170, 172 and attaching snaphook 168 to eye 150.

It is to be noted, as a feature of my invention, that pulley 28 is rotatable about a vertical axis, and that thus hand stirrup 174 may be used for exercise purposes by a user standing to the left of frame member 72, as seen in FIG. 1.

As also seen in FIG. 1, an additional captive cable 180 is provided which when unused is maintained against the front edge of post 52 by means of hooks 182, 184. Captive cable 180 is trained below pulley 40 and terminates in a snaphook 186 the purpose of which will be explained hereinbelow in connection with FIGS. 8 and 9.

As will now be evident to those having ordinary skill in the art, informed by the present disclosure, additional captive cable 46 is normally maintained against the front edge of post 56, and is provided at its lower end with a snaphook 190 which is engagable with eye 152. In a manner similar to that of the abovedescribed captive cables, captive cable 46 passes through beam 66, is trained over pulleys 32, 34, 36 and is provided at its outer end with a snaphook whereby it can be attached to suitable exercise apparatus the resistance of which is provided by independently operating carriage 24 and its associated weights.

Captive cable 48 is substantially identical to captive cable 44, being provided at its inner end with a snaphook engagable with eye 152 and provided at its outer end with a hand stirrup 190, after passing over rotatable pulley 38.

Captive cable 48 is provided with a stop 192 which prevents its upper end from passing completely over rotatable pulley 38. Similarly, captive cable 44 is provided with a stop 194 which prevents its upper end from completely passing over rotatable pulley 28.

Referring now to FIG. 2, there is shown an exploded view of carriage 24 and the parts of physical exercise device 10 which coact directly therewith.

Comparing FIGS. 1 and 2, it will be seen that carriage 24 is shown in FIG. 2 as located directly between posts 56 and 58 (FIG. 1), and vertically slidably mounted on rails 18 and 20 (FIG. 1). As further seen in FIG. 1, carriage 200 is comprised of a hollow body 200 through which there vertically passes a first tube 202 and a tube sleeve 204.

It is to be understood that body 200 and tubes 202 and 204 are all rigid, high strength structural members, and that tubes 202, 204 are affixed to the upper and lower walls of hollow carriage body 200, and thus are immovable with respect to carriage body 200.

As also seen in FIG. 2, tube 202 is provided at its upper and lower ends, respectively, with caps 206, 210, and sleeve 204 is provided at its upper and lower ends, respectively, with caps 208, 212. Each cap 206, 208, 210, 212 is securely affixed to one end of its associated sleeve, as shown in FIG. 2.

As further seen in FIG. 2, an eyepost 214 is affixed to the upper face of carriage body 200, and eye 152 (FIG. 1) is affixed to the upper end of eyepost 214.

As further seen in FIG. 2, a central circular opening 216 is provided in the major face of carriage body 200 shown therein. A substantially identical central circular opening 218 (FIG. 5) is provided in the opposite major face of carriage body 200.

Referring again to FIG. 2, it will be seen that a boss 220, the bore of which is concentric with opening 216 is affixed to the face of body 200 which contains opening 216. Similarly, a boss 222 (FIG. 5) the central bore of which is coaxial with openings 216, 218, and boss 220 is affixed to the major face of carriage body 200 which is not shown in FIG. 2.

As yet further seen in FIG. 2, shaft 112 passes through body 200 and bosses 220, 222, and, as explained in detail in FIG. 5, is journaled in bosses 220, 222 in such manner that it is freely rotatable with respect to body 200 but is constrained from longitudinal motion with respect to body 200, such that stub shafts 112', 112'' of substantially equal lengths project from bosses 220, 222.

As further seen in FIG. 2, a ring 224 is provided at the inner end of hook 124, and the inner diameter of ring 224 is close-fittingly slidable over stub shaft 112' until it bears against the outer face of boss 220. A set screw 226 is provided whereby ring 224 may be securely affixed to stub shaft 112', thus preventing longitudinal movement of shaft 112 to the right as seen in FIGS. 2 and 5.

As also seen in FIG. 2, collar 26'' is close-fittingly slidable over the outer end of stub shaft 112', and is also close-fittingly slidable over a reduced end portion 26''' of lift bar 26.

As also seen in FIG. 2, sliding collar 26'' is provided with two set screws 228, 230 whereby it may be securely affixed to stub shaft 112' and reduced lift bar portion 26'''.

As will be evident to those having ordinary skill in the art, the length of reduced portion 26''' is sufficient to accomodate the complete length of collar 26''.

It is to be understood that set screws 228, 230 may be replaced with spring-loaded pins which coact with aligned bores in stub shaft 112' and reduce lift bar portion 26'''.

Other fastening means for collars 26', 26'' will be provided by those having ordinary skill in the art, if desired, without the exercise of invention or undue experimentation.

As may be seen by comparison of FIGS. 1 and 2, the configuration of hook 124 is such that when it is affixed to stub shaft 112' as immediately hereinabove described its outer portion lies close to the common plane of the inner faces of posts 56, 58, whereby it is adapted to coact with pin 132 to support carriage 124 in the manner shown in FIG. 1.

Referring now to FIG. 2A, there is shown an alternative form of lift bar 236 which in the second preferred embodiment of my invention is substituted for lift bar 26 and shafts 110, 112 of the first preferred embodiment of my invention.

As will be understood by those having ordinary skill in the art, informed by the present disclosure, the lift bar 236 of the second preferred embodiment of my invention is not demountable, as is the lift bar 26 of the first preferred embodiment of my invention. Rather, the reduced ends 236', 236'' of unitary lift bar 236 are inserted into the associated carriages at the time of erection of the physical exercise device of the second preferred embodiment. Further, the length of the central, nonreduced portion of lift bar 236 is such that the ends thereof lie close to the rings of hooks 122, 124.

Thus, in the second preferred embodiment, barbell weights can be installed by the user only on the portions of lift bar 236 which project outwardly through the associated carriages.

While carriage 24 and its directly associated parts have been described in detail hereinabove in connection with FIG. 2, it will be understood by those having ordinary skill in the art, having reference to FIG. 1, that carriage 22 and its associated parts are essentially mirror-symmetrical to carriage 22 and its directly associated parts.

Referring now to FIG. 3, it will be seen that there is schematically represented therein a physical exercise apparatus 240 which is substantially identical to physical exercise apparatus 10. As seen in FIG. 3, a user 242 is utilizing physical exercise apparatus 240 in carrying out a conventional barbell exercise.

In carrying out this conventional barbell exercise, user 242 has installed a plurality of barbell weights 246 on the outer stub shaft of carriage 250, and has installed a corresponding plurality of barbell weights 248 on the outer stub shaft of carriage 252, and has secured lift bar 252 to carriages 250 and 252 by means of the sliding sleeves thereof.

Referring now to FIGS. 4 and 5, there is shown in detail the structure of carriage 24 and carriage stops 144, 146. It is to be understood that carriage 22 is substantially identical in construction to carriage 24, but is assembled in a mirror-image sense, and that carriage stops 140, 142 are substantially identical to carriage stops 144, 146.

As may be seen by comparison of FIGS. 4 and 5, carriage body 200 is hollow. Carriage body 200 may be fabricated from the same tubing as the frame members of physical exercise device 10, such as the posts 56, 58, and provided with flat end walls or plates which are secured thereto, e.g., by welding.

As seen in FIG. 4, two circular openings 260, 262 are provided in the upper and lower walls of carriage body 200, and sleeve 202 is secured therein against longitudinal movement with respect thereto.

Similar circular openings (not shown) are provided for sleeve 204, which is similarly fixed in those openings.

Boss 220 is affixed to carriage body 200 by suitable fasteners 264, 266, etc.

Caps 206, 208, 210, 212 are affixed to the respective extremeties of tubes 202, 204 by well known fastening means.

It is to be particularly noted that caps 206, 210 do not engage rail 20. Rather, the coaxial openings 268, 270 therein are clearance holes which at no time engage or contact rail 20.

As seen in FIG. 4, a bushing 272 is fixed in the upper end of tube 202, and a bushing 274 is fixed in the lower end of tube 202. These bushings are fixed in their respective ends of tube 202 by well known means the provision of which is within the scope of those having ordinary skill in the art without the exercise of invention or undue experimentation. Bushings 272 and 274 are fabricated from suitable lubricating or permanently lubricated material, such as Nylatron, and are the only parts of carriage 24 which contact rail 20.

Substantially identical bushings are secured in the upper and lower ends of tube 204, and coact with rail 18 in the same manner in which bushings 272, 274 coact with rail 20.

Thus, it will be understood by those having ordinary skill in the art, informed by the present disclosure, that carriage assembly 24 is provided with four outboard bushings or sleeve bearings 272, 274, etc., which coact with rails 18, 20 in such manner that carriage 24 is longitudinally slidable thereupon with virtually no sticking or "jittering", even when a substantially number of barbell disc weights are fixed to only one stub shaft, e.g., stub shaft 112".

Referring again to FIG. 4, it will be noted that carriage stop 144 is comprised of a coil spring 276 and two washers or plates 278, 280, and that the respective ends of coil spring 276 are affixed to washers 278, 280 in such manner as to maintain coil spring 276 substantially concentric with rail 20.

Carriage stop 144 is further comprised of a pin 282 provided at one end with a ring 284. As shown in FIG. 4, pin passes through a transverse hole 286 in rail 20, hole 286 being one of a plurality of holes 286 provided in rail 20 (FIG. 2.

As further seen in FIG. 4, carriage stop 146 is of substantially identical construction to carriage stop 144; as are carriage stops 140, 142 (FIG. 1).

Thus, it will be seen that each carriage stop can be selectively positioned at any one of a plurality of holes on its associated rail. Each hole 286 in rail 20 is located at the same distance above base 50 as three associated holes, one in each rail 14, 16, 18.

Referring now to FIG. 5, it will be seen that boss 220 is provided with a flange 290 which close-fittingly engages opening 216 in one of the major walls of carriage body 200 (FIG. 2).

Similarly, boss 222 is provided with a flange 292 which close-fittingly engages circular opening 218 in the opposite major face of carriage body 200.

Bosses 220 and 222 are affixed to carriage body 200 by suitable fasteners 264, 266, etc., as seen in FIG. 4, and thus bosses 220 and 222 are maintained in coaxial alignment.

As also seen in FIG. 5, boss 220 is provided with an internal shim or sleeve 294 and boss 222 is provided with an internal shim or sleeve 296. Sleeves 294 and 296 are fabricated from permanently lubricated or self-lubricating material, such as Nylatron, and are retained within the respective bosses 220, 222 by means the provision of which is within the scope of those having ordinary skill in the art.

As also seen in FIG. 5, shaft 112 is close-fittingly received in lubricating sleeves 294, 296, and thus is freely rotatable in carriage 24. As further seen in FIG. 5, a suitable retaining ring 298 of the snap ring type is maintained in a corresponding groove in shaft 112 in the well known manner, and a lubricating washer 300 formed from permanently lubricated or self-lubricating material is positioned between retaining ring 298 and the inner face of the flange portion 290 of boss 220.

Thus, it will be seen by those having ordinary skill in the art, informed by the present disclosure, that shaft 220 is prevented from moving leftwardly in FIG. 5, while at the same time allowed to freely rotate in carriage body 200.

As explained hereinabove, shaft 112 is prevented from shifting rightwardly, as seen in FIG. 1, by ring 224 of hook 124, which is secured to shaft 112 by means of set screw 226. Thus, as will be evident to those having ordinary skill in the art, informed by the present disclosure, shaft 112 is prevented from moving transversely with respect to carriage body 200, but is freely rotatable therein.

It is to be understood that a lubricating washer similar to washer 300 may be provided between ring 224 and boss 220 if found necessary or desirable by those having ordinary skill in the art.

Figure 7:
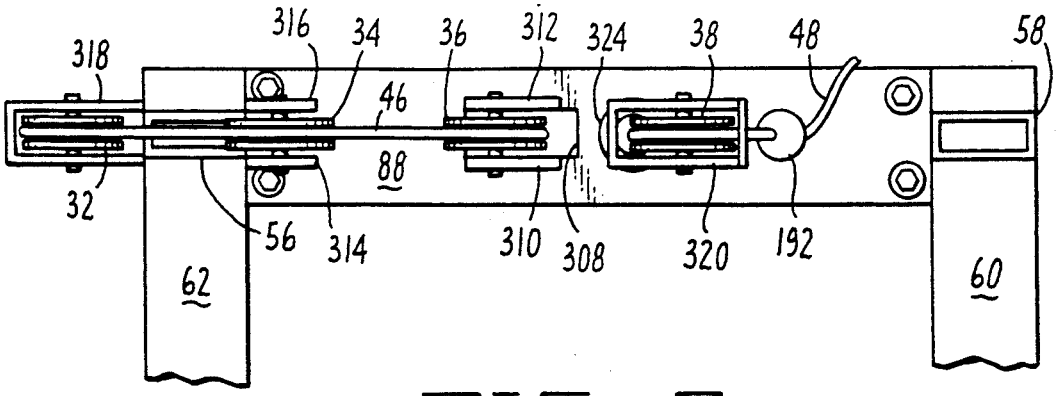
FIG. 7 is a partial plan view of the physical exercise apparatus shown in FIG. 1, particularly illustrating the pulleys and captive cables shown in FIG. 6.

Referring now to FIGS. 6 and 7, the arrangement of captive cable pulleys mounted on transverse beam 66 (FIG. 1) is shown in detail.

As seen in FIG. 6, captive cable 46 is passed through an opening 306 in bottom plate 90 of transverse beam 66, through a corresponding opening 308 in the top plate 88 of transverse beam 66, and then is trained over a series of three pulleys 36, 34, 32.

As may be seen by comparison of FIGS. 6 and 7, all three of these pulleys are mounted on fixed pulley mounts, such that their respective axes are maintained perpendicular to beam members 80, 82.

Pulley 36, for example, is rotatably mounted in a pulley mount comprised of a pair of mounting plates 310, 312, which plates are affixed to top plate 88 of transverse beam 66.

Similarly, pulley 34 is rotatably mounted between a pair of mounting plates 314, 316, which mounting plates are affixed to top plate 88.

Pulley 32, however, is mounted in a single yoke 318 which surrounds pulley 32 and coacts with stop 312 to prevent the end of captive cable 46 to which snap hook 310 is attached from passing over cable 32.

As further seen by comparison of FIGS. 6 and 7, pulley 38, over which captive cable 48 passes, is mounted in a rotatable block 320.

As best seen in FIG. 6, block 320 is affixed to the upper end of a hollow cylindrical member 322 which itself is journaled in the upper end of a second hollow cylindrical member 324. Hollow cylindrical member 324 is affixed to the top plate 88 of transverse beam 66, its bore in registration with a hole 326 which passes through plate 88, and is directly above opening 306 in bottom plate 90.

Since, as noted above, hollow cylindrical member 322 is journaled in hollow cylindrical member 324, it follows that block 320 is rotatable about the common axis of cylindrical members 322 and 324.

As shown in FIG. 6, captive cable 48 passes upward through opening 306 and hole 326, thence through the internal bores of members 322 and 324 and over pulley 38.

By this feature of my invention it is rendered possible for a user standing outside frame 12 and beyond one end thereof to utilize hand stirrup 190 (FIG. 1) which is connected to the end of captive cable 48 beyond stop 192.

As explained hereinabove, and indicated in FIG. 6, captive cable 46 may be detached from its storage hooks 302, etc., and attached instead to eye 152, whereby the weight of carriage 24 and its associated barbell discs may be used to provide resistance for exercise in connection with a load applying device, such as a butterfly apparatus, attached to snaphook 310.

Alternatively, captive cable 48 may be detached from its storage hooks 304, etc., and its lower end attached to eye 152, whereby the weight of carriage 24 and its associated barbell discs may be used to provide resistance for physical exercise employing hand stirrup 190 (FIG. 1).

Figure 9:
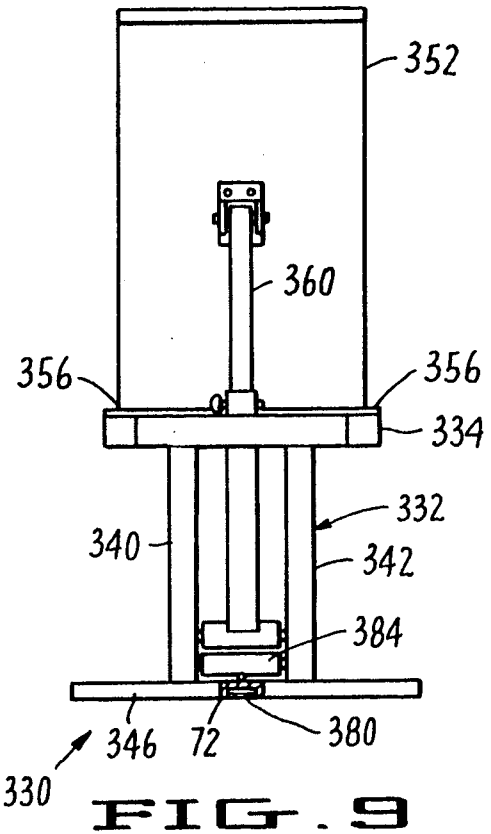
FIG. 9 is an end view of the exercise bench shown in FIG. 8, taken on plane 9—9 of FIG. 8.
Figure 8:
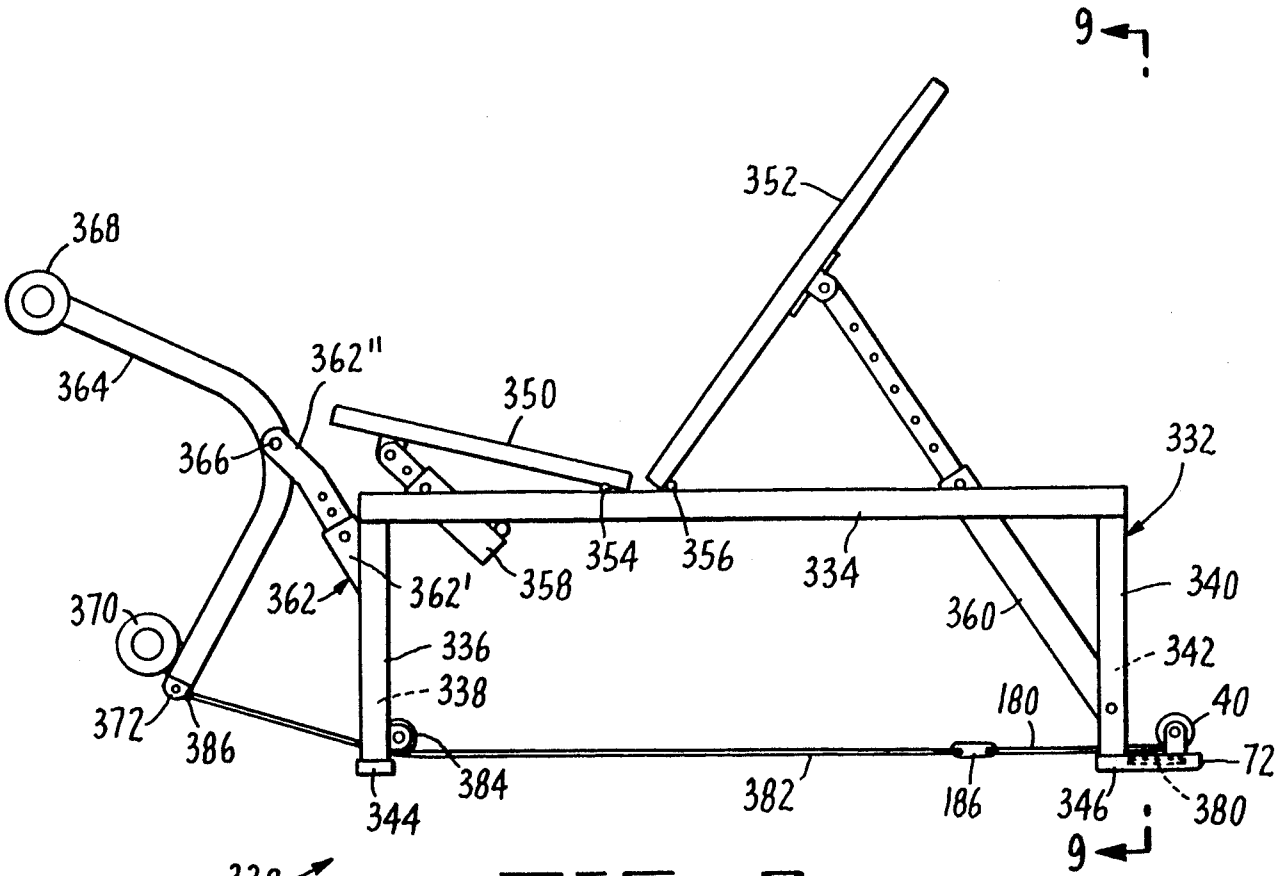
FIG. 8 is a side view of an exercise bench of my invention which is particularly adapted to cooperate with the physical exercise apparatus shown in FIG. 1.

Referring now to FIGS. 8 and 9, there is shown a leg exercise bench 330 embodying certain aspects of my invention and constructed to cooperate with physical exercise device 10 of the first preferred embodiment of my invention or certain other physical exercise apparatuses embodying my invention.

As may be seen by comparison of FIGS. 8 and 9, leg exercise bench 330 is comprised of a frame 332 which consists of a horizontal, rectangular open frame 334 supported by four legs 336, 338, 340, 342 the upper ends of which are rigidly affixed to frame 334 and the lower ends of which are rigidly affixed to a pair of cross braces 344, 346.

A pair of padded table top segments 350, 352 are both hingedly affixed to frame 334 by means of hinges 354, 356 the outer pivot rod receiving portions of which are affixed to frame 334 in the positions shown in FIG. 8.

Table top segment 350 is provided with a telescoping prop 358 by means of which it can be maintained at a plurality of different, selected angles with respect to frame 334.

Similarly, table top segment 352 is provided with a telescoping prop 360 by means of which it can be maintained at different, selected angles with respect to frame 334.

An outwardly projecting arm 362 (FIG. 8) is provided at the end of frame 334 adjacent the shorter table top segment 350.

As seen in FIG. 8, arm 362 is a telescoping arm which is comprised of a larger, hollow inner arm portion 362' in which an outer arm portion 362'' is telescopingly received.

Inner arm segment 362' is affixed to legs 336, 338, in such manner that its angle with respect to those legs is unchangeable.

Outer segment 362'' is telescopingly received in inner segment 362', and can be withdrawn from inner segment 362' by different amounts, whereby to select different overall lengths for arm 362. Any one of these overall arm lengths may be selected and maintained by means of a suitable pin passing through cooperating holes in inner arm segment 362' and outer arm segment 362'', in the same manner in which the respective lengths of props 358 and 360 are selectably fixed.

As also seen in FIG. 8, a yoke 364 is pivoted to the outer end of arm 362 by means of a pivot 366.

Yoke 364 is provided at its outer ends which two padded cross bars of the type well known in other leg exercise apparatus.

An eye 372 is provided at the lower end of yoke 364, the purpose of which eye will be described hereinbelow.

As may further be seen by comparing FIGS. 8 and 9, a tongue 380 is affixed to crossbrace 346, projecting outwardly therefrom.

As best seen in FIG. 8, tongue 380 is adapted to be close-fittingly received within the hollow interior of base member 72 (FIG. 1), thereby maintaining bench 330 in alignment with base member 72.

As also seen in FIG. 8, the lower end of captive cable 180 (FIG. 1), which is trained below pulley 40 (FIG. 1) is passed between legs 340, 342, and its outer snap hook 186 is then affixed to one end of a cable 382.

As also seen in FIG. 8, cable 382 passes beneath a roller 384 which is journaled between legs 336, 338, and thereafter is affixed by means of a suitable snap hook 386 to eye 372 at the bottom end of yoke 364.

It is to be understood that in order to prepare bench 330 for use in carrying out leg exercises of the well known type, captive cable 180 (FIG. 1) is disengaged from its storage hooks 182, 184, and the eye at the upper end thereof secured to snap hook 162 of captive cable 42, after disengaging eye 164 of lat bar 166 from snap hook 162, snap hook 158 (FIG. 1) being first attached to eye 150.

It will thus be seen that the objects set forth above, among those made apparent from the preceding description, are efficiently attained, and since certain changes may be made in the above constructions and the method carried out thereby without departing from the scope of my invention, it is intended that all matter contained in the above description or shown in the accompanying drawings shall be interpreted as illustrative only, and not in a limiting sense.

It is also to be understood that the following claims are intended to cover all of the generic and specific features of my invention hereindescribed, and all statements of the scope of my invention which, as a matter of language, might be said to fall therebetween.

What is claimed is:

1. Physical exercise apparatus, comprising:

a rigid frame;

a first plurality of vertical rails mounted on said frame;

a second plurality of vertical rails mounted on said frame;

a first carriage independently slidably mounted on said first plurality of rails;

a second carriage independently slidably mounted on said second plurality of rails;

first exercise weight carrying means mounted in said first carriage and having an inner cantilever portion located within said frame and an outer cantilever portion;

second exercise weight carrying means mounted in said second carriage and having an inner cantilever portion located within said frame and an outer cantilever portion;

a lift bar adapted to be secured to both of said inner cantilever portions for joint vertical movement of said carriages, the length of said lift bar being less than the distance between said carriages so that said lift bar can be secured to said inner cantilever portions after the mounting of at least one exercise weight thereupon; and a plurality of discate exercise weights each having a central mounting hole of such diameter as to close-fittingly receive any one of said cantilever portions.

2. Physical exercise apparatus as claimed in claim 1 in which each of said carriages includes a plurality of pairs of sleeve bearings, each pair of sleeve bearings slidably cooperating with one of said rails.

3. Physical exercise apparatus as claimed in claim 1, in which each of said carriages further comprises attaching means for attaching thereto a cable connected to a load applying device for applying an exercising load to a part of a human body.

4. Physical exercise apparatus as claimed in claim 1, further comprising hook means irrotatably attached to each of said exercise weight carrying means and projecting outwardly therefrom, and hook receiving means engagable with said frame at a plurality of different heights, whereby each of said carriages may be arrested at a selected one of a plurality of predetermined heights.

5. Physical exercise apparatus as claimed in claim 1 in which each of said exercise weight carrying means is rotatably mounted in its associated one of said carriages.

6. Physical exercise apparatus, comprising:

a rigid frame;

a first plurality of vertical rails mounted on a first end of said frame;

a second plurality of vertical rails mounted on a second end of said frame;

a first carriage independently slidably mounted on said first plurality of rails;

a second carriage independently slidably mounted on said second plurality of rails;

first exercise weight carrying means mounted in said first carriage and having an inner cantilever portion located within said frame and an outer cantilever portion;

second exercise weight carrying means mounted in said second carriage and having an inner cantilever portion located within said frame and an outer cantilever portion;

a lift bar adapted to be secured to both of said inner cantilever portions for joint vertical movement of said carriages, the length of said lift bar being less than the distance between said carriages so that said lift bar can be secured to said inner cantilever portions after the mounting of at least one exercise weight thereupon;

a plurality of discate exercise weights each having a central mounting hole of such diameter as to close-fittingly receive any one of said cantilever portions;

a first plurality of pulleys mounted on said first and of said frame;

a second plurality of pulleys mounted on said second end of said frame;

a first cable trained over said first plurality of pulleys;

a second cable trained over said second plurality of pulleys;

attaching means for attaching said first cable to said first carriage;

attaching means for attaching said second cable to said second carriage;

attaching means for attaching said first cable to load applying means for applying an exercise load to a part of a human body; and attaching means for attaching said second cable to load applying means for simultaneously applying an exercise load to a part of a second human body.

7. Physical exercise apparatus as claimed in claim 6 in which each of said carriages includes a plurality of pairs of sleeve bearings, each pair of sleeve bearings slidably cooperating with one of said rails.

8. Physical exercise apparatus as claimed in claim 6 further comprising hook means irrotatably attached to each of said exercise weight carrying means and projecting outwardly therefrom, and hook receiving means engagable with said frame at a plurality of different heights, whereby each of said carriages may be arrested at a selected one of a plurality of predetermined heights.

9. Physical exercise apparatus as claimed in claim 6 in which said first exercise weight carrying means is rotatably mounted in said first carriage and said second exercise weight carrying means is rotatably mounted in said second carriage.

* * * * *